United States Patent [19]

Schueler

[11] 3,937,377

[45] Feb. 10, 1976

[54] CHOPPER FOR MARGINS OF MULTI-FOLDED PAPER

[75] Inventor: Marlin A. Schueler, San Leandro, Calif.

[73] Assignee: American/Durein Company, Oakland, Calif.

[22] Filed: Oct. 11, 1974

[21] Appl. No.: 514,007

[52] U.S. Cl. ..... 225/94; 83/302; 83/923; 225/97

[51] Int. Cl.[2] ..... B26D 1/56; B26F 3/02

[58] Field of Search ..... 83/302, 349, 355, 356.3, 83/408, 423, 856, 858, 923; 225/94, 97, 103; 241/222, 223, 242, 243, 101.4

[56] References Cited

UNITED STATES PATENTS

| | | | |
|---|---|---|---|
| 352,960 | 11/1886 | Swanger | 83/356.3 |
| 2,214,160 | 9/1940 | Carr | 83/302 |
| 2,308,551 | 1/1943 | Sherman | 83/423 X |
| 2,643,065 | 6/1953 | Clawson | 225/97 X |
| 2,739,647 | 3/1956 | Coste | 83/356.3 |
| 3,060,778 | 10/1962 | Karber | 241/222 X |
| 3,545,689 | 12/1970 | Luscombe | 83/355 X |
| 3,762,256 | 10/1973 | Frantz | 83/356.3 |
| 3,774,485 | 11/1973 | Kercher | 83/408 X |
| 3,779,123 | 12/1973 | Chafee | 83/356.3 X |
| 3,799,020 | 3/1974 | Hoelmer | 83/356.3 X |

*Primary Examiner*—J. M. Meister
*Assistant Examiner*—Fred A. Silverberg
*Attorney, Agent, or Firm*—Robert G. Slick

[57] ABSTRACT

A chopper for severed margins of multi-folded paper is provided wherein the margins are slit off the sheet and then chopped into small pieces which occupy a minimum amount of space and which present a simplified disposal problem.

5 Claims, 3 Drawing Figures

CHOPPER FOR MARGINS OF MULTI-FOLDED PAPER

SUMMARY OF THE INVENTION

Computers and other modern business machines frequently employ multiple folded paper, the paper having edge margins with perforations or sprocket holes therein, the perforations mating with drive sprockets or tractors which move the paper through a processing machine. In many applications, the margins containing the perforations are not needed after the paper passes through the machine and are slit off so that the desired record paper will occupy the minimum amount of storage space. Slitters have been employed for many years in this application but the slitters produce a long, tape-like cutting and this cutting is difficult to dispose of. It will not automatically fall neatly into a bin but instead it is ordinarily necessary to provide some manual means for dealing with the long tapes that are cut off. Further, such long tapes are not easy to store or to dispose of.

In accordance with the present invention, a chopper device is provided which follows a slitter; the chopper chops or tears the tape into a series of short, irregular pieces. These pieces will fall into a bin or the like and occupy a minimum space and are easy to handle.

In the past, attempts have been made to cut the tapes into short lengths but such cutting devices did not prove successful since the perforated tape would bend at the end of the hole, making it difficult to cut.

In contrast, the device of the present invention has a series of staggered, tearing blades, so that a plurality of the spaced, staggered blades enter the tape and literally tear it apart either at the perforations or between them.

In accordance with one aspect of the invention, a plurality of chopper blades are used which are not rigidly mounted on a shaft but are maintained in spaced alignment with some give or leeway so that the machine has little tendency to bind.

Various additional features of the invention will be brought out in the balance of the specification.

DESCRIPTION OF THE PREFERRED EMBODIMENTS

Figure 1:
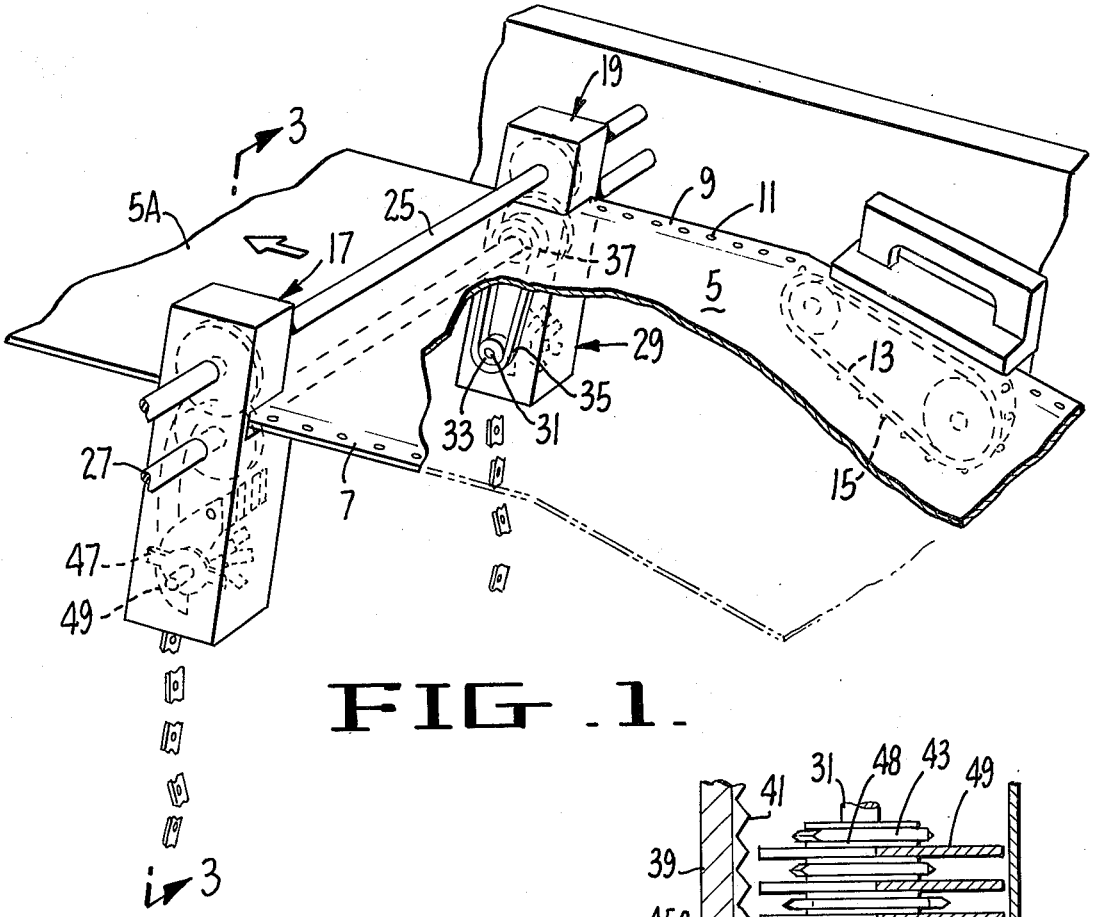
FIG. 1 is a perspective view of a portion of a paper processing machine showing a paper drive mechanism, an edge slitting mechanism, and the chopper which constitutes the gist of the present invention.

Referring now to the drawings by reference characters, there is shown a manifold paper 5 having margin edges 7 and 9, each of which has spaced perforations 11 therein. The paper is driven through the machine by sprockets, or preferably, by so-called tractors, which have an endless belt 13 having a series of lugs 15 thereon which engage the sprocket holes 11. Ordinarily, two such tractors would be employed, one on each side of the sheet, but only one is shown in FIG. 1.

Figure 3:
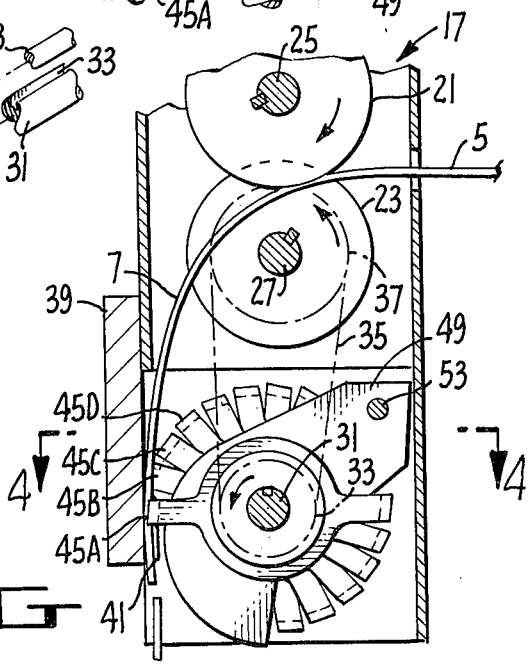
FIG. 3 is an enlarged side view of the machine on the line 3—3 of FIG. 1.

Although the margin edges with their sprocket holes are necessary for driving paper through the various processing machines, it is highly desirable that these margins be cut off so that the paper can be stored in a minimum amount of space. For this purpose, margin cutters such as those generally designated 17 and 19 are employed on either side of the sheet. These consist of rotary knives 21 and 23 mounted on shafts 25 and 27 respectively, driven by motor means, not shown. These rotary knives are well known to those skilled in the art so that they will not be described in detail. When the knives encounter the sheet 5, an edge 7 is cut off which drops away as is best seen in FIG. 3, while the balance of the sheet continues through the machine as is shown in 5A.

Figure 4:
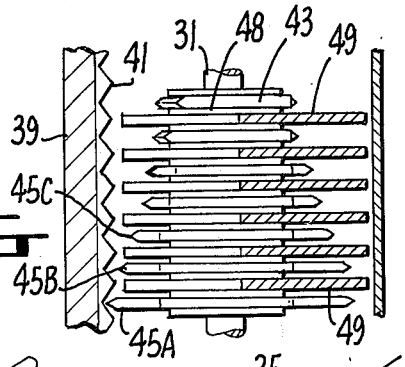
FIG. 4 is a section on the line 4—4 of FIG. 3.
Figure 2:
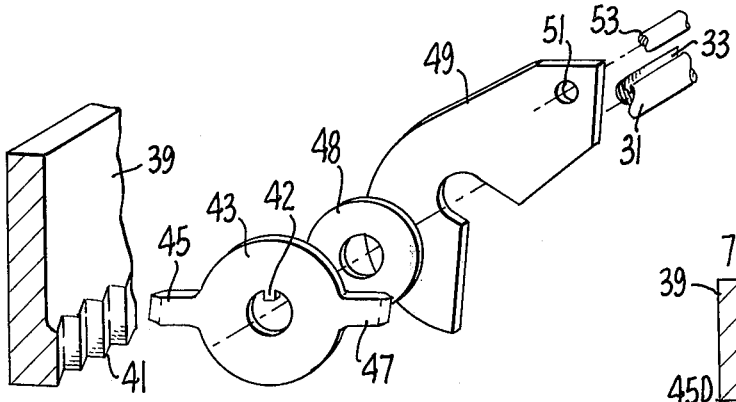
FIG. 2 is an exploded view of the fixed cutting blade, one of the chopper blades, a spacer washer, and a supporting arbor.

The margin 7 comes off as a long, tape-like strip and, as has been pointed out above, it is difficult to deal with such material. In accordance with the present invention, highly-effective chopper units are employed, one being mounted under each pair of rotary knives. Since these devices are mirror images of each other, only one will be described in detail. The chopping device fits within a housing generally designated 29 and this holds a shaft 31 mounted for rotation. Shaft 31 has a pulley 33 at the end thereof and it is driven by belt 35 from pulley 37 mounted on shaft 27. Pulley 35 is considerably smaller than pulley 37 so that shaft 31 is driven at a substantially higher speed than the shaft 27. Mounted on one side of the housing 29 is a fixed cutter 39 and a series of teeth 41 formed across one entire side. Shaft 31 carries a series of knives 43, each of which has two teeth 45 and 47 extending on opposite sides. Between each of the knives 43 is a spacer 48 and a shaft support member 49. Shaft support member 49 is pivoted through holes 51 on rod 53. It will be understood that there are a plurality of the knives, spacers, and support members across the width of the chopper as is best seen in FIGS. 3 and 4. The choppers are staggered around 180° so that one chopper is just leaving the chopping grooves as the next approaches and so on. Thus, referring now to FIGS. 3 and 4, successive teeth have been designated 45A, 45B and so on to illustrate how the blades are arranged. Shaft 32 has a spline 33 cut therein and each of the knives 43 has an inwardly extending tooth 42 adapted to engage the spline. The teeth 42 of the knives are offset with respect to the teeth 45 and 47 from one knife to the next to yield the helical configuration of the teeth best seen in FIG. 3.

Knives 43 are not held rigidly on the shaft but some leeway is provided so that they can shift back and forth slightly. Also, it will be seen that the holders 49 which support shaft 31 are not held rigidly in place but can move to some extent on shaft 53. Thus, as the tape enters the space between the rotating knives 43 and the fixed cutter 39, a first rotating knife will engage the margin 7 adjacent one edge thereof and will begin to tear the margin from said one side. An adjacent knife subsequently engages the margin spaced inwardly from said one edge and continues the tear, and so on, until the margin is torn across its width and highly irregular pieces are produced. Since the blaces can move slightly from side-to-side and also the entire holder can move up-and-down slightly, there is substantially no possibility of the chopper jamming.

Although the device was specifically designed for use with a machine for processing paper business forms, it is obvious that it is applicable to any device wherein it is desired to chop a tape or similar material into a plurality of small, irregular pieces which are easy to handle. The device of the present invention is capable of handling heavy materials such as cardboard or plastic.

Although a specific embodiment of the invention has been described, it will be obvious to those skilled in the art that many deviations can be made from the exact structure shown without departing from the spirit of this invention.

I claim:

1. A chopper for chopping tape and the like into small pieces, comprising: a stationary chopping blade having a series of angular teeth in line thereon defining grooves therebetween; a shaft supported for rotation parallel to the line of teeth; a series of pivoted support members supporting said shaft; a plurality of knives mounted on said shaft, each of said knives having at least one tooth element fitting into a groove of the chopper blade; means supporting said knives on said shaft in staggered relationship whereby one knife enters a groove at a time; and means connected for rotating said shaft.

2. The chopper of claim 1 wherein said chopper is employed with a slitter having a driven shaft, the shaft of said chopper being driven from the shaft of said slitter.

3. The structure of claim 1 wherein said knives are loosely keyed to said shaft, with a spacer between each of said knives.

4. A chopper for chopping a tape and the like into small pieces, comprising: a stationary chopper blade having a series of angular teeth in line thereon defining grooves therebetween; a shaft supported for rotation parallel to the line of teeth; a plurality of knives mounted on said shaft for rotation with said shaft and for movement relative to said shaft, each of said knives having at least one tooth element fitting into a groove of the chopper blade; means supporting said knives on said shaft in staggered relationship whereby one knife enters a groove at a time; said means including a projecting lug on each knife extending into a slot in the shaft, and spacer means on the shaft on opposite sides of each knife, said lug and spacer means dimensioned to loosely support the knives on the shaft for side-to-side movement relative to one another and to the shaft to prevent jamming of the knives; and means connected for rotating said shaft.

5. The structure of claim 4 wherein said shaft is supported on a series of pivoted support members.

* * * * *